United States Patent [19]

Lohrmann et al.

[11] Patent Number: 5,040,780

[45] Date of Patent: Aug. 20, 1991

[54] SHEET FEEDING APPARATUS FOR SEPARATING INDIVIDUAL SHEETS FROM STACKS OF SHEETS OF DIFFERENT RELATIVE STIFFNESS

[76] Inventors: Gerhard Lohrmann, Lerchenweg 30, D-7915 Elchingen 1; Kurt Röhrer, Friedrichstr. 17, D-7908 Niederstotzingen, both of Fed. Rep. of Germany

[21] Appl. No.: 547,638

[22] Filed: Jul. 2, 1990

[30] Foreign Application Priority Data

Jul. 4, 1989 [DE] Fed. Rep. of Germany ..... 3922293

[51] Int. Cl.[5] ..... B65H 3/52

[52] U.S. Cl. ..... 271/124; 271/127

[58] Field of Search ..... 271/22, 121, 124, 127, 271/147, 170

[56] References Cited

U.S. PATENT DOCUMENTS

| | | | |
|---|---|---|---|
| 3,592,462 | 7/1971 | Fackler | 271/170 |
| 4,582,314 | 4/1986 | Yamamoto et al. | 271/127 |
| 4,838,535 | 6/1989 | Yokoi et al. | 271/127 |

FOREIGN PATENT DOCUMENTS

| | | | |
|---|---|---|---|
| 147737 | 6/1988 | Japan | 271/22 |
| 192638 | 8/1989 | Japan | 271/127 |

*Primary Examiner*—Robert P. Olszewski
*Assistant Examiner*—Steve Reiss
*Attorney, Agent, or Firm*—Cohen, Pontani & Lieberman

[57] ABSTRACT

In a sheet feeding apparatus for separating individual sheets (1*b*, 1*c*) of different stiffness from stacks (1*d*) thereof, the stack is pressed under the urgency of a spring force against separating rollers (9) and the sheet supply container (1) has an inclined front wall surface (10) on its front wall (4) upon which the stacked sheets are supported. A pair of arms (12) carrying separating elements (3) on their lower ends are carried on the supply container side wall (1*a*) for substantially parallel movement therealong. The arms (12) are implemented as linearly-movable switch slides (13) which are reciprocally displaceable between a lowered position in which the separating element end surfaces (15) rest against the supply container front wall surface (10) or the front region (11) thereof, and an upper or raised position in spaced apart relation to and providing a well-defined clearance (16) relative to the topmost sheet in the stack (1*d*).

24 Claims, 3 Drawing Sheets

SHEET FEEDING APPARATUS FOR SEPARATING INDIVIDUAL SHEETS FROM STACKS OF SHEETS OF DIFFERENT RELATIVE STIFFNESS

FIELD OF THE INVENTION

The present invention is directed to sheet feeding apparatus capable of operatively separating individual sheets from stacks of sheets of different relative stiffness or thickness.

BACKGROUND OF THE INVENTION

Devices for separating individual sheets to be printed from stacks of such sheets and capable of doing so with respect to sheets of considerably different thickness or relative flexibility or stiffness are known in the art. It is of particular interest that such devices have the ability to separate or individualize both relatively thin and highly flexible paper sheets, on the one hand, and relatively thicker or stiffer envelopes, on the other hand, from stacks thereof.

One heretofore-known apparatus for loading individual sheets into an office machine is disclosed in published European Patent Document No. EP-A2-01 06 801. This apparatus is intended to provide for ready separation of individual sheets and adaptation to different paper widths. More particularly, the separating elements are constructed as individualizing corners fastened to a bent portion of a swing plate which is mounted for rotation about an axis of rotation to a side wall of the sheet storage container. The storage container includes an inclined front wall surface which extends into a rounded portion, whereby the individual sheets rest on only the rounded portion of the inclined front wall surface when the separating elements are rotatably swung away for accommodating sheets or envelopes of increased or relatively greater thickness or stiffness.

This known structure is not, however, particularly advantageous when switching the rotatable swing plate between positions for accommodating one or the other of highly flexible paper sheets and relatively stiff envelopes. For one thing, the switched end positions of the rotatable swing plates are not well defined and, furthermore, significant additional clearance or free space about the swing plates must be provided to accommodate their rotational movement.

SUMMARY OF THE INVENTION

It is accordingly the desideratum of the present invention to avoid the disadvantages of prior art, rotatable swing plates while providing a space-saving arrangement for effectively accommodating and implementing a structural arrangement for separating individual sheets of significantly varied thickness or stiffness or flexibility from stacks of such sheets in a sheet feeding apparatus.

This and other objects are achieved, in accordance with the present invention, in a sheet feeding apparatus wherein arms which carry the separating elements are structured as substantially vertically-oriented, linearly-movable switch slides reciprocally movable or displaceable along linear guides. At the lower end or position of switch slide movement, the end surfaces of the separating elements carried on the arms rest on or abut against the front wall surfaces of the paper stack storage container, or on a front region thereof, and in the upper position of displacement from the storage container front wall surface the separating elements define a predetermined free space or clearance with respect to the stack of sheets. This construction advantageously provides clearly defined and repeatable end positions for the switch slides, and accordingly for the separating elements carried thereby, while taking up and requiring, during the switching operation, only a relatively small amount of space. Moreover, even when the separating elements are displaced from and lifted off of the stack in the upper position of the switch slides, a front sheet guide effective for preventing the unintended separation of sheets from the stack is present, thereby maintaining the stack in appropriate form for the operative feeding of individual sheets therefrom. The apparatus of the invention further provides particular ease of operation and user control and ready loading or introducability, into the storage container, of stacks of sheets to be separated and fed.

In accordance with one aspect of the invention, the separating elements are formed as angle pieces, each bent in respectively opposite directions to define corners and carried on the otherwise substantially flat switch slides. The separating elements can accordingly be economically manufactured together with or as integral portions of the switch slides from sheet metal or injection molded plastic.

Since it is not required that the separating elements form specially-configured three-dimensional angle pieces or parts, the manufacture thereof is simplified and they may be shaped with greater freedom. In particular, in further accordance with the invention an inside or inner surface of the angle pieces that form the separating elements extends substantially parallel to the topmost sheet in the stack from which individual sheets are to be fed. As a consequence, simple bending of an end portion of the flat switch slide member is sufficient for producing a suitable separating element integrally carried on the slide.

In the operation of the inventive apparatus, an individual or topmost sheet to be separated from the stack is pushed forward by rotation of a separating roller, in the direction of feeding or advance, without the need to first pull back or retract the sheet such as in some prior art devices. This feature is supported by configuring the separating elements so that they are cut or obliquely-angled from inside to outside along the edge of the angle pieces.

Further use-facilitating features of the inventive apparatus lie in the ability to lock the switch slides in their lower and upper end positions of linear movement or displacement, and the provision of a user-engageable or graspable knob on each switch slide for enabling manual operator selection and adjustment of the position of the switch slides and, correspondingly, of the operability of the sheet separating functionality of the invention for accommodating various paper thicknesses or stiffnesses.

Other objects and features of the present invention will become apparent from the following detailed description considered in conjunction with the accompanying drawings. It is to be understood, however, that the drawings are designed solely for purposes of illustration and not as definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
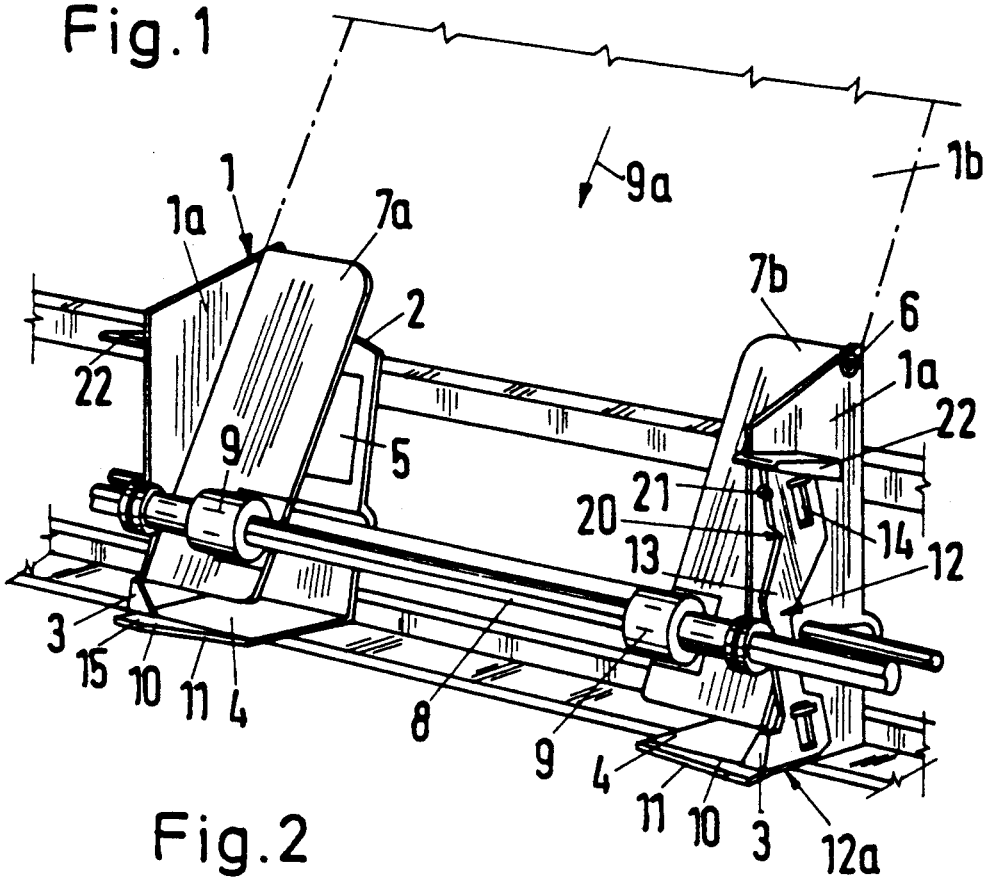
FIG. 1 is a elevated perspective view of an apparatus constructed in accordance with the present invention and adjustably disposed in a first condition for the feeding of flexible individual sheets.

With initial reference to FIG. 1, the sheet feeding and separating apparatus there shown includes a paper stack storage compartment or container 1 defined by side walls 1*a* and frame plates 2 connected thereto. The separating apparatus is operatively effective for alternatively feeding both flexible individual sheets 1*b* (FIG. 1), consisting for example of highly flexible paper sheets of ordinary thickness such as are commonly used in photocopiers and the like, as well as for relatively stiff individual sheets 1*c* (FIG. 2) such, for example, as relatively thick or inflexible envelopes. In each case, the individual sheets 1*b* and individual stiff sheets or envelopes 1*c* are releasably held or maintained in a stack 1*d* in the storage or supply container 1. A continuous shaft 8 carries individualizing or separating rollers 9 for rotation in the direction of sheet advance 9*a*. The rollers 9 are normally maintained in sheet-transporting pressing engagement with the topmost sheet in the stack 1*d* and, to effectuate this arrangement, the stack 1*d* rests on spring-actuated tray plates 7*a*, 7*b* which urge the stack toward the rollers 9 so that the rollers 9 press against the topmost sheet. More particularly, each of the tray plates 7*a*, 7*b* is supported against a respective one of the frame plates 2 by a leg spring 5, one leg of which presses against a respective frame plate 2 and the other leg of which rests against one of the tray plates 7*a*, 7*b*. The tray plates are also rotatably movable about shafts 6 on the frame plates 2.

With even a relatively small oblique or angled orientation of the stack 1*d*, the stack rests against and is supported by a front wall 4 of the supply container 1. In this regard, depending upon the relative angularity or oblique orientation of the stack 1*d*, relative displacements between individual ones of the flexible sheets 1*b* or relatively stiff sheets 1*c* might be expected to occur. In addition to or as part of the front wall 4, the supply container 1 includes an angularly-inclined front wall surface 10 for facilitating separation or individualization of sheets 1*b*, 1*c* from the stack 1*d*, one at a time, and thus preventing simultaneous separation and transport of multiple sheets from the stack. Mounted on the side walls 1*a*, which are adjustable to accommodate specific widths of paper sheets held in the supply container 1, are arms 12 which are disposed in and for movement along substantially parallel planes which extend substantially perpendicular to the plane of the sheets in the stack 1*d*. A separating element 3 is fastened or formed integral with or otherwise carried on the lower-disposed end 12*a* of each arm 12. The arms 12 are, in addition, adjustable for maintaining their selectively adjustable positions for enabling the individualized feeding of, respectively, thin sheets and relatively thicker or stiffer envelopes or the like from the stack 1*d*.

Figure 3:
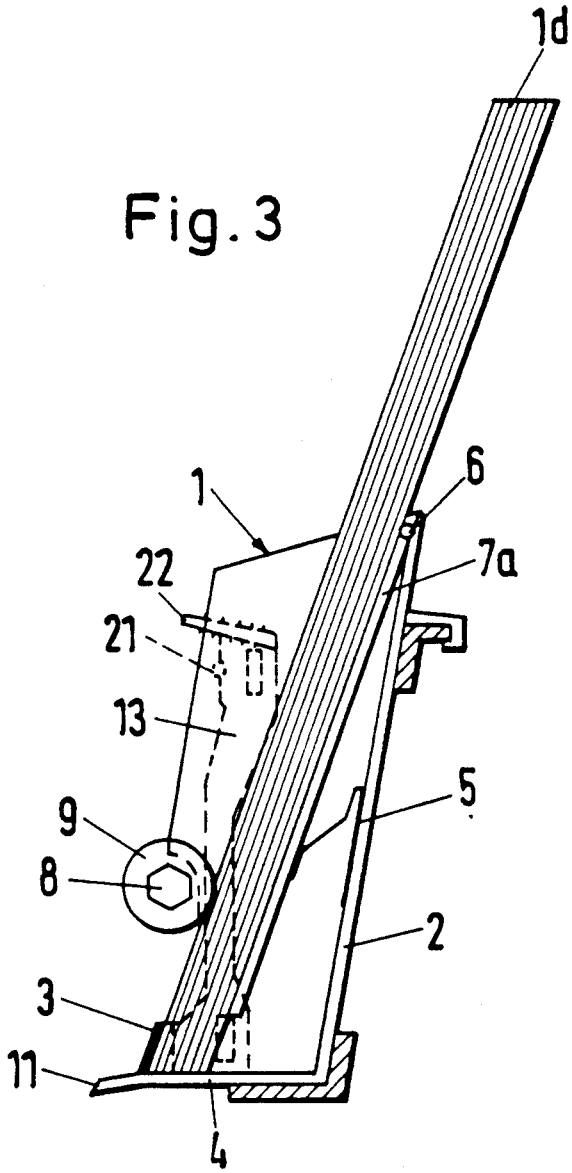
FIG. 3 is a partial side view of the apparatus as shown in FIG. 1.
Figure 5:
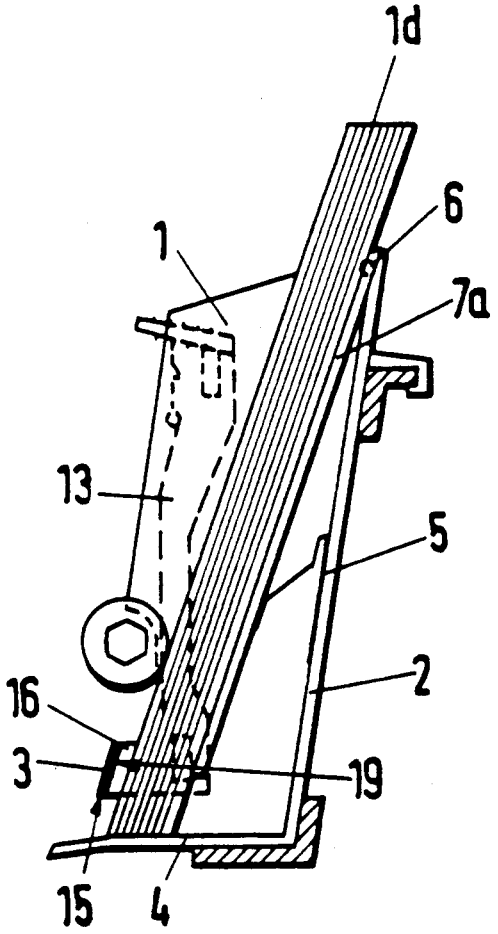
FIG. 5 is a partial side view of the apparatus as shown in FIG. 2.

More particularly, in the presently disclosed embodiment the arms 12 carrying the separating elements 3 are fabricated as switch slides 13 that are linearly movable along or with respect to linear guides 14. In their lowermost position along the linear guide 14, an end face or surface 15 of each separating element 3 rests against or abuts the front wall surface 10 of the storage container 1 (FIG. 3). In the upper or opposite position of each switch slide 13, the separating element 3 is upwardly spaced from the storage container wall surface 10 and, in addition, forms a well-defined free space or clearance 16 with respect to the topmost sheet of the stack 1*d* (FIG. 5). The free space 16 is predeterminately dimensioned so that a sheet stack 1*d* is readily insertable or loadable, with adequate play, into the storage container 1 while, at the same time, providing sufficient guidance of the stack 1*d* so that the stack is prevented from falling apart through separation of some or all of the sheets in the stack or, for example, partly or completely tipping over from its substantially vertically-inclined or angled orientation.

As seen in the drawings, the separating elements 3 may be unitarily fabricated as integral parts of the substantially flat switch slides 13. To form the separating elements 3, the generally flat member or material of each slide 13 is bent to form a corner 17 from which an angle piece or part 18 extends, each switch slide angle piece 18 extending, in opposite directions, one toward the other, unlike prior art separating element arrangements, the angle pieces 18 do not abut or contact the lateral edges of the stack 1*d*.

Each angle piece 18 is further formed so that its inner side or face 19 extends substantially parallel to the plane of the topmost sheet 1*b*, 1*c* in the stack 1*d*. Separation or individualizing of the topmost sheet is facilitated by further configuring the separating elements 3 so that the angle pieces 18 are cut obliquely from inside to outside or, in other words, so that the ascending edge of each angle piece 18 is obliquely angled from the inside toward the outside of the sheet feed apparatus as, for example, best seen in FIGS. 1 and 2.

Figure 4:
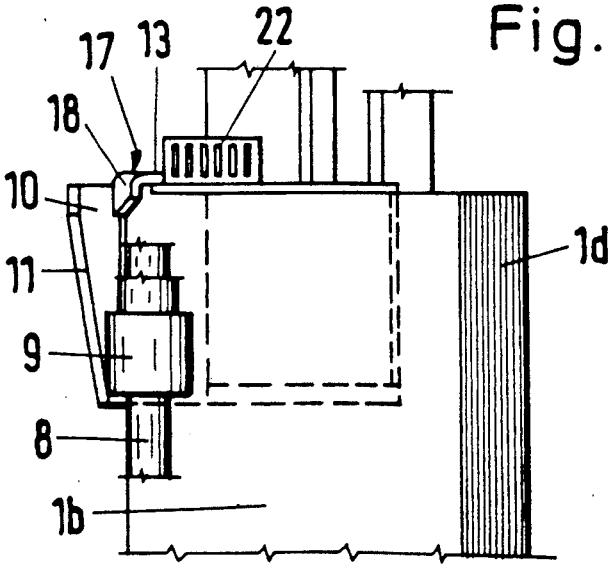
FIG. 4 is a top view of the apparatus shown in FIG. 3.

The switch slides 13 are advantageously securable or lockable in each of their lower (FIGS. 3 and 4) and upper (FIGS. 5 and 6) positions of reciprocal travel or displacement. For this purpose, each switch slide 13 includes a pair of detent troughs 20 that are alternately engageable with a suitably located detent pin 21 depending from the respective side wall 1*a* of the sheet feeding and separating apparatus. Each switch slide 13 is additionally provided with a user-engageable or grippable or graspable knob 22 carried at the top of the slide to facilitate manually-effected user adjustment or displacement of the switch slide between its raised and lowered positions.

For the feeding and separation of individual sheets 1*b* of weight up to about 100 grams per square meter, the switch slides 13 are disposed in their lower position (FIGS. 1, 3 and 4) with the separating elements 3 lying against container front wall 4. The tray plates 7*a*, 7*b*, which are mounted for spring-urged pivotal rotation about the shafts 6 press the sheet stack 1*d*, more particularly the topmost sheet in the stack, against the separating rollers 9 and, at the bottom corners of the topmost sheet, against or into close proximity to the inner faces 19 of the separating element angle pieces 18. Upon driven rotation of the rollers 9 in the direction of sheet advance 9*a*, the topmost sheet 1*b* is separated and transported from the remainder of the stack 1*d*. In this regard, the forward advance of the sheet 1*b* is initially blocked or prevented by the overlying separating elements 3 until, as a result of the transverse arching of the topmost sheet, its lower corners or outer edges snap over the angle pieces 18 and thereby permit forward transport of the sheet 1*b* from atop the stack 1*d*. The storage container front wall surface 10 is preferably bent or inclined or angled, in the direction of sheet advance 9*a*, at its front region 11 by a suitable amount so that, during forward advance of the paper sheet, only the transversely-arched topmost sheet 1*b* slides over the obliquely-cut edge of each angle piece 18 to achieve separation and forward transport of only that topmost sheet.

Figure 2:
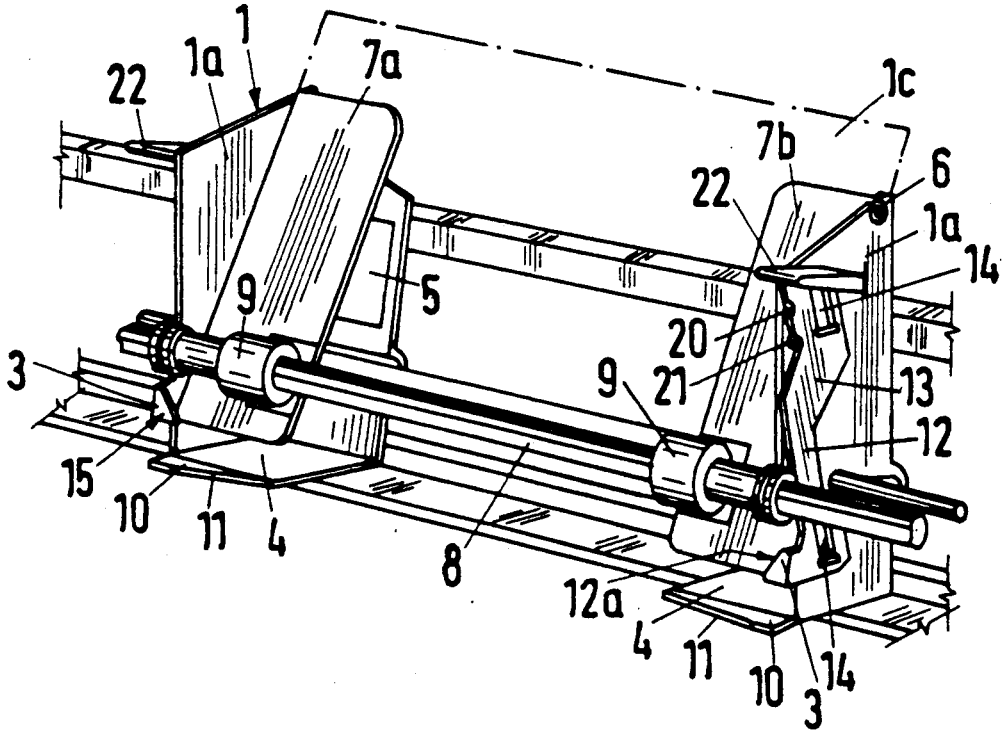
FIG. 2 is an elevated perspective view similar to FIG. 1 and showing the apparatus in a second condition of adjustment for the feeding of relatively stiffer envelopes.
Figure 6:
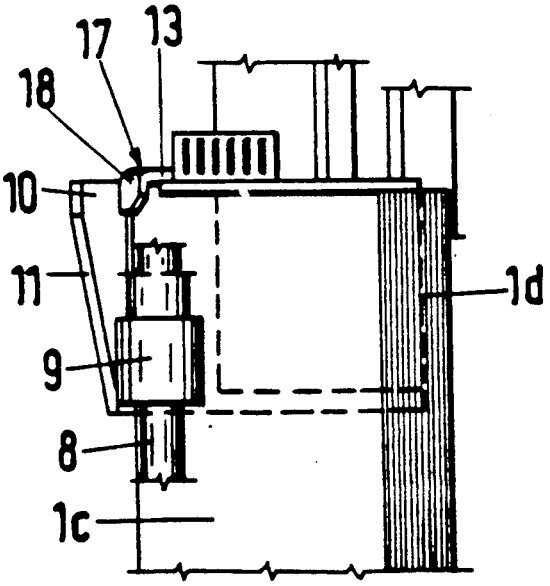
FIG. 6 is a top view of the apparatus shown in FIG. 5.

To accommodate and enable single sheet feeding of relatively stiffer sheets 1*c*, such as envelopes, the switch slides 13 are moved into or displaced to their upper positions (FIGS. 2, 5 and 6). The separating elements 3 are thereby carried upwardly away from and into spaced apart relation with the storage container front wall surfaces 10 and, at the same time, so that the angle pieces 18—particularly the inner faces 19—are spaced from the topmost sheet 1*c* of the stack 1*d* and thereby define the free space or clearance 16 therebetween. In this manner, all obstacles to movement of the outer corners of the relatively stiff individual sheets 1*c* are eliminated, while maintaining the angle pieces 18 in sufficient proximity to the stack 1*d* to prevent unintended separation or movement of other than the topmost sheet 1*c* from the substantially vertically-inclined and oriented stack. And, as heretofore noted, only one relatively stiff sheet 1*c*, such for example as an envelope, is thereby operatively separated from the stack and transported over the front wall surface 10. By virtue of their inherent stiffness, none of the other sheets 1*c* in the stack are transported at the same time as the topmost sheet over the obliquely-angled front region 11 of the storage container front wall 4.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A sheet feeding apparatus operable for separating individual sheets from stacks of sheets of different relative stiffness, comprising:

a storage container (1) for holding a stack (1*d*) of sheets (1*b*, 1*c*), said storage container comprising a front wall (4) for supporting the stack, said front wall (4) including an angled front wall surface (10), and a pair of side walls (1*a*) spaced apart by an amount adjustable to conform to the width of the sheets in the stack;

a separating roller (9) operatively rotatable for feeding individual sheets (1*b*, 1*c*) from the stack (1*d*) in a direction of sheet advance (9*a*);

a spring-loaded tray (7*a*, 7*b*) for supporting the stack and normally urging the stack toward the separating roller (9) so that a topmost sheet in the stack is pressed against the separating roller;

a pair of arms (12) carried on said side walls (1*a*)for movement along substantially parallel planes between a first position for enabling the separation of relatively flexible sheets (1*b*) from the stack and a second position for enabling separation of relatively stiffer sheets (1*c*) from the stack, each said arm (12) comprising a substantially vertically-oriented switch slide (13) carrying a separating element (3) at its lower end, each said separating element (3) including an end surface (15), and each said switch slide (13) being linearly-movable along a respective one of said side walls (1*a*) between said first position in which said separating element end surface (15) rests on said storage container front wall surface (10) for enabling feeding of a single relatively flexible sheet (1*b*) from the stack, and said second position in which said separating element end surface (15) is spaced from said storage container front wall surface (10) and said separating element (3) defines a clearance space (16) relative to the topmost sheet in the stack for enabling feeding of a single relatively stiffer sheet (1*c*) from the stack; and linear guide means (14) for guidedly accomodating said linear movement of the switch slides (13) along said side walls (1*a*) between said first and second positions of the switch slides.

2. A sheet feeding apparatus in accordance with claim 1, wherein each said switch slides (13) comprises a substantially flat member, and each said separating element (3) comprises an angle piece (18) formed by bending said switch slide flat member at a corner (17) and extending in the direction of the other said separating element.

3. A sheet feeding apparatus in accordance with claim 2, wherein said angle piece (18) includes an inner face that extends substantially parallel to the topmost sheet (1*b*, 1*c*) in the stack (1*d*).

4. A sheet feeding apparatus in accordance with claim 1, wherein each said separating element (3) includes an obliquely-angled edge.

5. A sheet feeding apparatus in accordance with claim 2, wherein said separating element angle piece (18) includes an obliquely-angled edge.

6. A sheet feeding apparatus in accordance with claim 3, wherein said separating element angle piece (18) includes an obliquely-angled edge.

7. A sheet feeding apparatus in accordance with claim 1, further comprising means for locking said switch slides (13) in each of said first and second positions.

8. A sheet feeding apparatus in accordance with claim 2, further comprising means for locking said switch slides (13) in each of said first and second positions.

9. A sheet feeding apparatus in accordance with claim 3, further comprising means for locking said switch slides (13) in each of said first and second positions.

10. A sheet feeding apparatus in accordance with claim 4, further comprising means for locking said switch slides (13) in each of said first and second positions.

11. A sheet feeding apparatus in accordance with claim 5, further comprising means for locking said switch slides (13) in each of said first and second positions.

12. A sheet feeding apparatus in accordance with claim 6, further comprising means for locking said switch slides (13) in each of said first and second positions.

13. A sheet feeding apparatus in accordance with claim 1, further comprising a user-engageable knob (22) on each said switch slide (13) for enabling user-effected movement of said switch slide between said first and second positions.

14. A sheet feeding apparatus in accordance with claim 2, further comprising a user-engageable knob (22) on each said switch slide (13) for enabling user-effected movement of said switch slide between said first and second positions.

15. A sheet feeding apparatus in accordance with claim 3, further comprising a user-engageable knob (22) on each said switch slide (13) for enabling user-effected movement of said switch slide between said first and second positions.

16. A sheet feeding apparatus in accordance with claim 4, further comprising a user-engageable knob (22) on each said switch slide (13) for enabling user-effected movement of said switch slide between said first and second positions.

17. A sheet feeding apparatus in accordance with claim 5, further comprising a user-engageable knob (22) on each said switch slide (13) for enabling user-effected movement of said switch slide between said first and second positions.

18. A sheet feeding apparatus in accordance with claim 6, further comprising a user-engageable knob (22) on each said switch slide (13) for enabling user-effected movement of said switch slide between said first and second positions.

19. A sheet feeding apparatus in accordance with claim 7, further comprising a user-engageable knob (22) on each said switch slide (13) for enabling user-effected movement of said switch slide between said first and second positions.

20. A sheet feeding apparatus in accordance with claim 8, further comprising a user-engageable knob (22) on each said switch slide (13) for enabling user-effected movement of said switch slide between said first and second positions.

21. A sheet feeding apparatus in accordance with claim 9, further comprising a user-engageable knob (22) on each said switch slide (13) for enabling user-effected movement of said switch slide between said first and second positions.

22. A sheet feeding apparatus in accordance with claim 10, further comprising a user-engageable knob (22) on each said switch slide (13) for enabling user-effected movement of said switch slide between said first and second positions.

23. A sheet feeding apparatus in accordance with claim 11, further comprising a user-engageable knob (22) on each said switch slide (13) for enabling user-effected movement of said switch slide between said first and second positions.

24. A sheet feeding apparatus in accordance with claim 12, further comprising a user-engageable knob (22) on each said switch slide (13) for enabling user-effected movement of said switch slide between said first and second positions.

* * * * *